US005365997A

United States Patent [19]

Helgesen et al.

[11] Patent Number: 5,365,997

[45] Date of Patent: Nov. 22, 1994

[54] METHOD FOR PREPARING AN ENGINE BLOCK CASTING HAVING CYLINDER BORE LINERS

[75] Inventors: Gary D. Helgesen, Romulus; Robert G. Rentschler, Dearborn; Thomas J. Heater, Farmington Hills, all of Mich.

[73] Assignee: Ford Motor Company, Dearborn, Mich.

[21] Appl. No.: 972,793

[22] Filed: Nov. 6, 1992

[51] Int. Cl.[5] ..... B22D 19/08; B22D 19/04

[52] U.S. Cl. ..... 164/103; 164/98; 164/370; 164/341

[58] Field of Search ..... 164/98, 102, 105, 108, 164/493, 100, 112, 369, 370, 338.1, 339, 340, 341, 103

[56] References Cited

U.S. PATENT DOCUMENTS

| | | | |
|---|---|---|---|
| 1,309,182 | 7/1919 | Clerget | 164/103 |
| 1,528,947 | 3/1925 | Preston | 164/105 |
| 2,387,971 | 10/1945 | Aspin | 138/147 |
| 3,769,880 | 11/1973 | Mirjanic | 123/193.2 |
| 3,877,126 | 4/1975 | Deutschmann et al. | 29/156.4 |
| 4,284,041 | 8/1981 | Rasch et al. | 123/193 |
| 4,337,736 | 7/1982 | Rasch et al. | 123/193 |
| 4,495,684 | 1/1985 | Sander et al. | 29/156.5 |
| 4,528,950 | 7/1985 | Oblander et al. | 123/193 |
| 4,700,444 | 10/1987 | Yamagata | 29/156.4 |
| 4,711,208 | 12/1987 | Sander et al. | 123/271 |
| 4,785,522 | 11/1988 | Biro | 29/527.6 |
| 4,817,578 | 4/1989 | Ushio et al. | 123/668 |
| 4,856,462 | 8/1989 | Ushio et al. | 123/41.84 |
| 4,905,642 | 3/1990 | Suzuki et al. | 123/195 |
| 4,908,923 | 3/1990 | Anderson et al. | 29/888.01 |
| 4,953,612 | 9/1990 | Sare et al. | 164/102 |
| 4,986,230 | 1/1991 | Panyard et al. | 123/193 |
| 5,232,041 | 8/1993 | Kuhn | 164/105 |

FOREIGN PATENT DOCUMENTS

| | | | |
|---|---|---|---|
| 53-41621 | 4/1978 | Japan . | |
| 56-1258 | 1/1981 | Japan . | |
| 57-146464 | 9/1982 | Japan . | |
| 58-112649 | 7/1983 | Japan . | |
| 58-181464 | 10/1983 | Japan . | |
| 60-102260 | 6/1985 | Japan . | |
| 61-216845 | 9/1986 | Japan . | |
| 62-21454 | 1/1987 | Japan | 164/98 |
| 63-230926 | 9/1988 | Japan . | |
| 3-42164 | 2/1991 | Japan | 164/98 |

*Primary Examiner*—P. Austin Bradley
*Assistant Examiner*—Rex E. Pelto
*Attorney, Agent, or Firm*—Roger L. May; Joseph W. Malleck

[57] ABSTRACT

A method for preparing an engine block casting having integral cylinder bore liners (10). A barrel slab core (14) includes barrel cores (18). Bore liners (10) surround the barrel cores (18) and are fixed in relation to the barrel slab core (14). A cylinder block mold core package (22) is assembled from the barrel slab core (14), and other cores (24, 26, 28). The liners (10) are heated while they are within the cylinder block mold core package (22) by induction heating. Access holes (30) are defined within the barrel slab core (14), each access hole (30) communicating with the interior of one barrel core (18). A heater (32) is inserted through each access hole (30). Thermal energy is thus transferred across the barrel core (18) to the cylinder bore liner (10) to assure optimum integrity of bonding between a solidified cylinder block casting and the cylinder bore liners (10). The heaters (32) are then retracted before adding the molten metal.

10 Claims, 6 Drawing Sheets

METHOD FOR PREPARING AN ENGINE BLOCK CASTING HAVING CYLINDER BORE LINERS

BACKGROUND OF THE INVENTION

1. Field Of The Invention

This invention relates to the cylinders of an internal combustion engine and has particular reference to a process for the construction of cylinders having liners disposed within the bores thereof.

2. Related Art Statement

The cylinder bore walls of internal combustion engines must be made of a material which will provide resistance to the abrasive action of the combustion seal rings of a piston. In traditional cast iron engine blocks, cast iron alone will provide sufficient wear resistance for the life of the engine. However, in applications where a lighter weight engine block material is used, such as aluminum, liners must be inserted into the cylinder bores to provide the required wear resistance.

In the past, there have been various approaches to the "shrink in place" or "press-in" cylinder bore liners. Such approaches include the steps of heating a partially machined cylinder block to 400°–450° F. to expand the cylinder bores. Precision machined liners are then inserted therewithin. As the block cools, the aluminum contracts, and the liners become secured in place.

Other related methods include shrinking the liners by cooling them in a substance such as liquid nitrogen and inserting them into an ambient temperature engine block casting whose bores have been machined to a diameter slightly smaller than the ambient temperature outside diameter of the liner to create an interference fit. Another method, less often used, is simply to press liners, whose outside diameters are slightly larger than the cylinder bores, into engine block castings at ambient temperature.

These processes without modification tend to produce a deficiency in the finished engine which is referred to as liner migration: radial and axial movement of the liner during engine operation.

Another approach commonly used for liner insertion, referred to as cast-in liners, makes the liner an integral part of the engine block casting during the casting process. This can be accomplished using many traditional metal casting processes including die casting, semi-permanent mold and low pressure casting.

In many conventional cast-in liner aluminum block processes, notably those having metal molds, liners are typically preheated with a suitable device (such as a furnace, radiant heater, induction heater, etc.) outside the mold, before mold assembly. Such liners are then installed on mandrels within the mold.

Processes which utilize an all sand core mold render the insertion of liners during mold assembly virtually impossible. This is because the mold assembly requires complex juxtaposition of mating cores, which takes time during which a heated liner would otherwise cool. Earlier experience has led to an interest in determining whether methods might be available to heat the cylinder bore liners within the assembled mold package.

In the past, cast-in liners have been viewed as not being feasible in high volume production using sand casting processes because of the difficulty with heating the liners and inadequate control of liner location. Accordingly, it would be beneficial to have available cast-in liners which would eliminate liner migration and to reduce engine plant facility investment.

Relevant to the goal of economical manufacture of internal combustion engines are the requirements of economy in machining, simplified castings, and ease of assembly. The present invention addresses these requirements in a manner set forth below.

SUMMARY OF THE INVENTION

One aspect of this invention is a method for preparing an engine block casting having integral cylinder bore liners.

The method comprises the steps of inserting the bore liners within a core box which is adapted for shaping a barrel slab core. The barrel slab core includes a plurality of barrel cores. Surrounding each of the barrel cores is a bore liner so that the liners are integrally formed with the barrel slab core. Each liner includes a design feature which secures it to the barrel core, assures its positional accuracy, and prevents it from migration during preheating.

A cylinder block mold package is assembled from chemically bonded sand cores including the barrel slab cores, end cores, crank case cores, and side cores. Next, the liners are heated while they are within the assembled cylinder block mold package by induction heating. Molten metal, preferably an aluminum or magnesium alloy, is then poured into the cylinder block mold package for forming the engine block casting.

Advantageously, access holes are defined within the barrel slab core, each access hole communicating with the interior of one barrel core. An induction heater is then inserted through each access hole so that thermal energy may be transferred across the barrel core to preheat the bore liner, thus assuring optimum integrity of a bond between a solidified cylinder block casting and each bore liner. The heaters are retracted before adding the molten metal.

Preferably, the induction heater is energized so that it delivers a predetermined amount of energy. The molten metal is added within a predetermined time after the heating step. Preheating the cylinder bore liners tends to avoid the generation of heat sinks which may tend to lead to thermal variations and associated imperfections. As a result, surface contact between the liner and the metal which surrounds it is improved. With induction heating, preheat temperatures are controlled more closely and the time during which the cores are exposed to the heated liners is beneficially reduced.

The present invention will become more fully understood from the detailed description given below and the accompanying drawings.

BEST MODES FOR CARRYING OUT THE INVENTION

Figure 1:
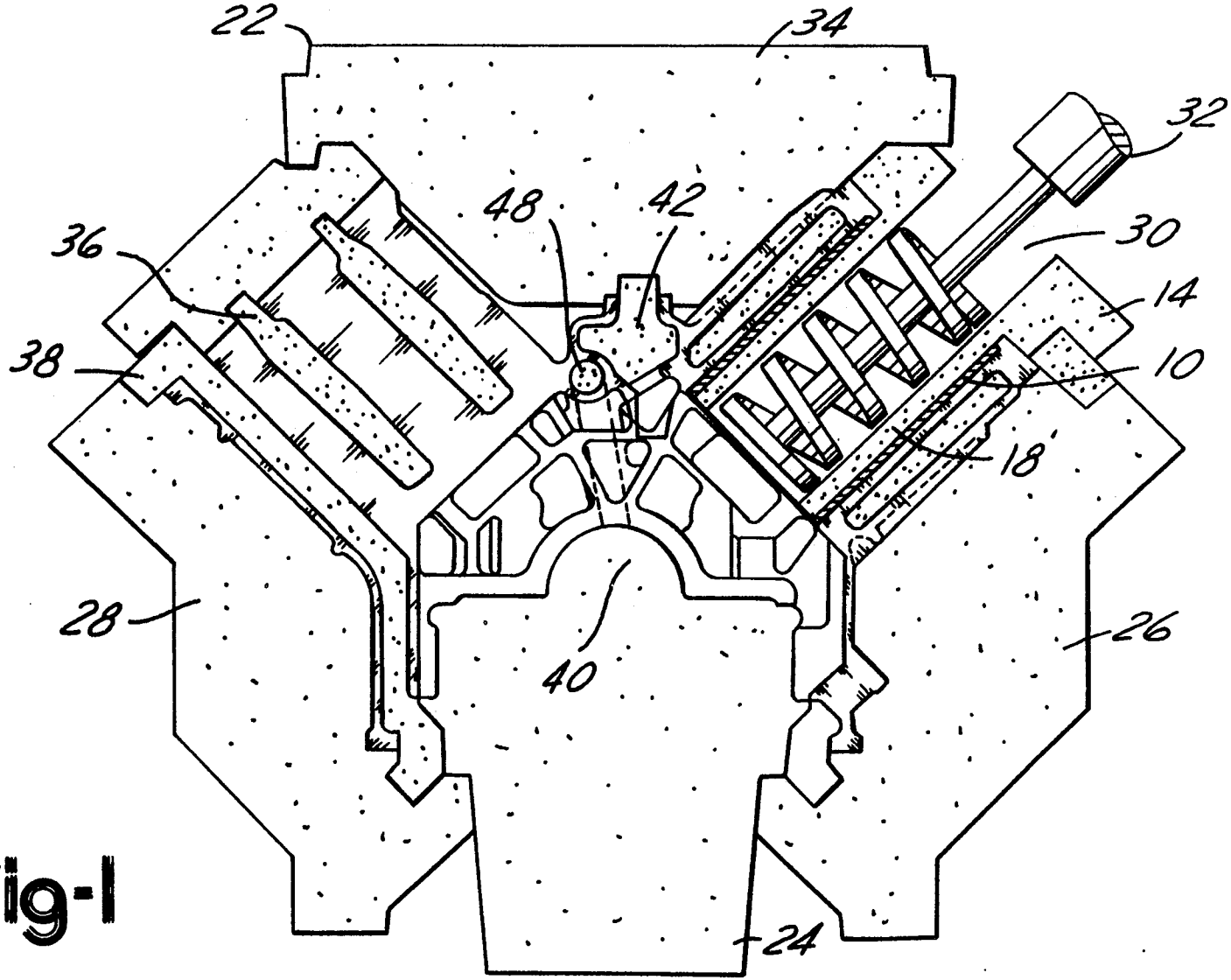
FIG. 1 is a sectional view of a bonded sand cylinder block mold package for forming an engine block casting.
Figure 2:
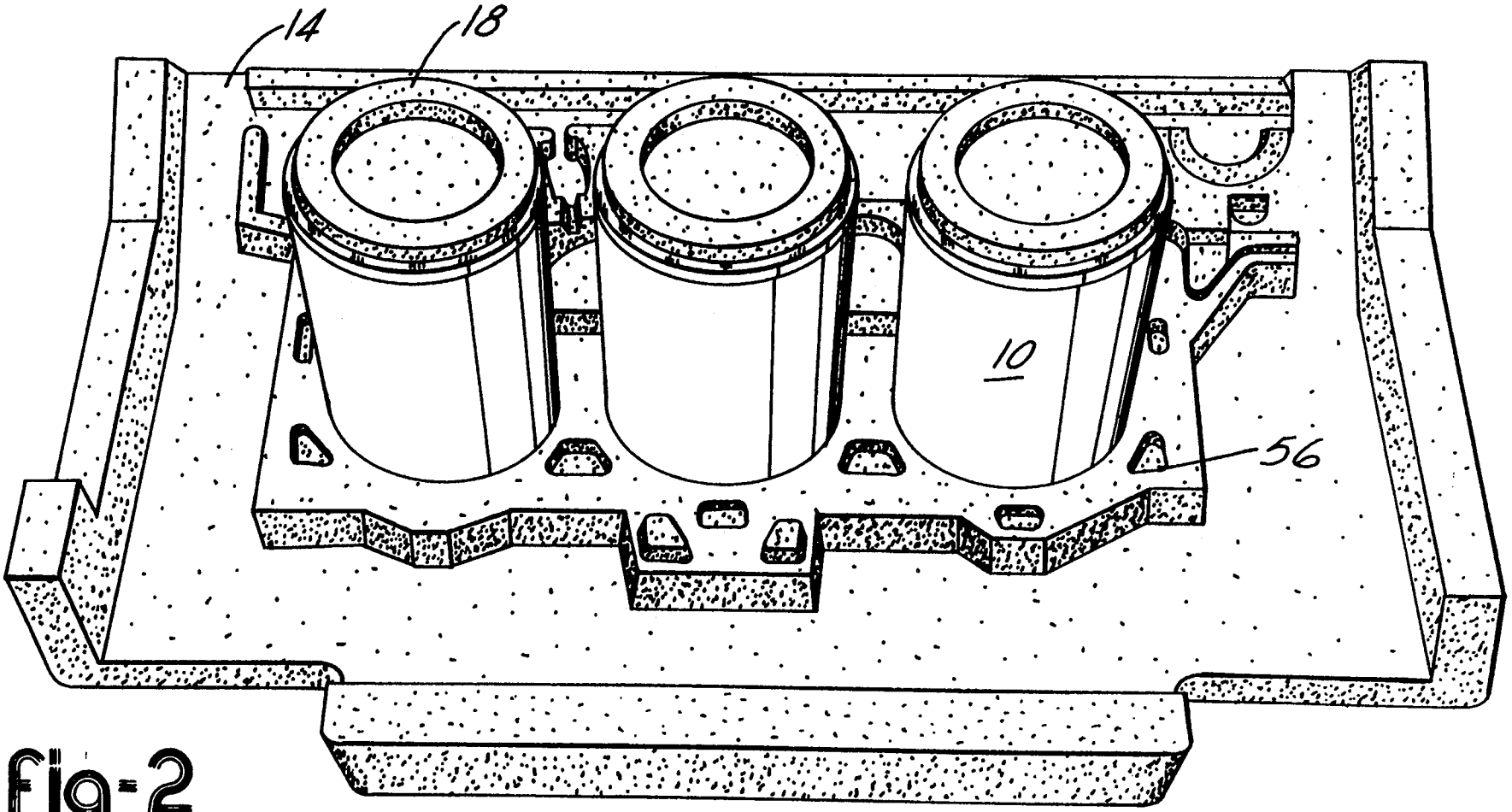
FIG. 2 is a perspective view of a barrel slab core including cylinder bore liners disposed upon the barrel cores thereof.

FIG. 1 depicts a cross-sectional view of a cylinder block mold core package 22. Interposed between a left side core 26 and a valley core 34 is a barrel slab core 14, which is shown also in FIG. 2.

Figure 7:
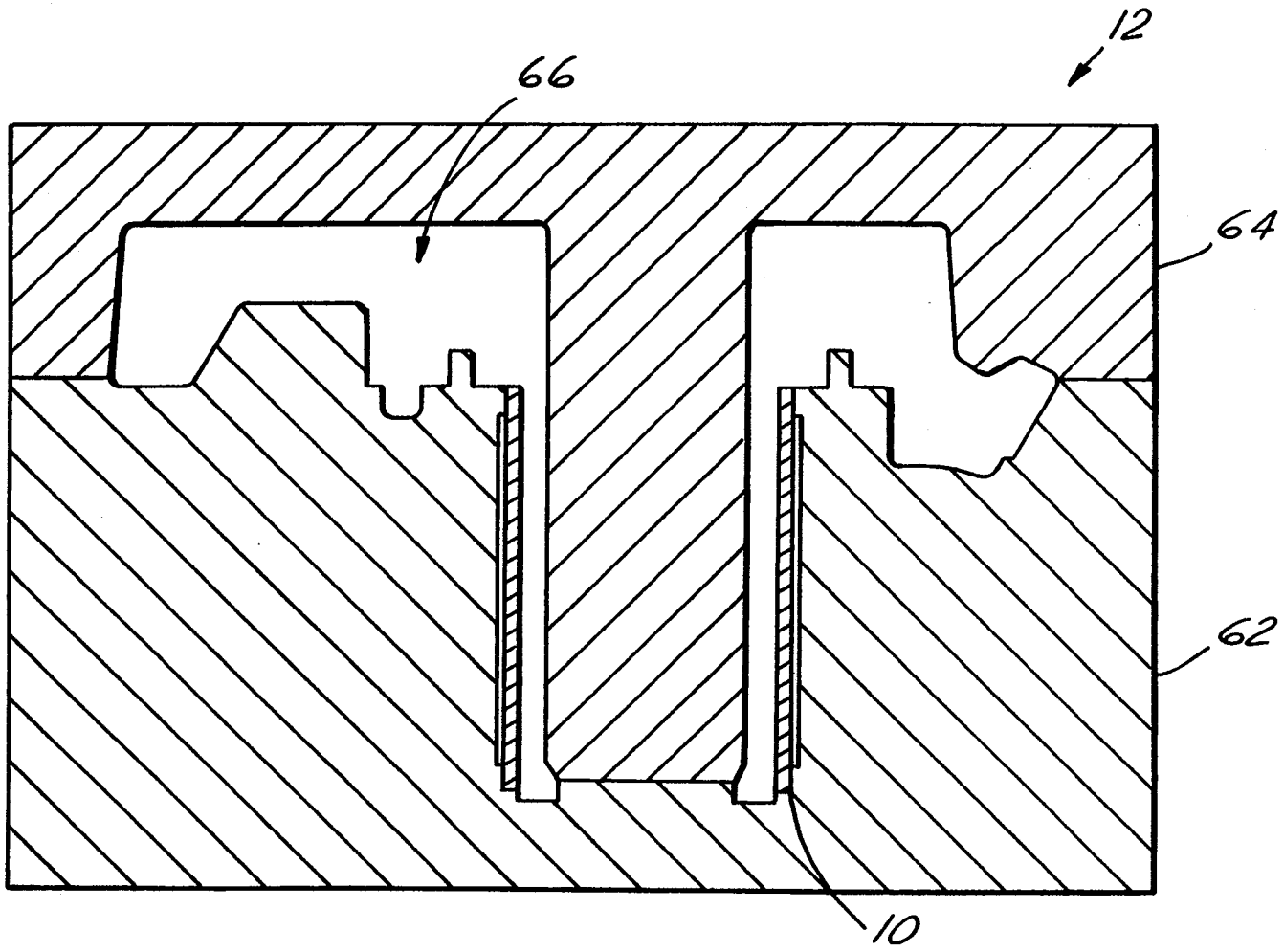
FIG. 7 is a sectional view through a barrel slab core box.

To prepare the barrel slab core 14 (FIGS. 1, 2), cast iron cylinder bore liners 10 are positioned in the lower portion 62 of a core box 12 (FIG. 7). The core box 12 includes a core box cover 64 which is placed atop of a lower portion 62 of the core box. Each liner 10, the core box cover 64, and the lower section 62 of the core box, define therebetween a cavity 66 into which a sand mix is blown to form the barrel slab core 14. The bottom of the outside diameter of the liner 10 is precision machined (typically to a tolerance of 0.04 mm) for accurate location within the core box. The box 12 is then closed and the core 14 (FIGS. 1, 2) is produced in a conventional manner using any known core making process, such as a Furan hot box or a phenolic urethane cold box. Cores can be made using any of a variety of sands such as silica, zircon, fused silica, and others. To practice the disclosed invention, the core box 12 was used primarily with zircon. Materials for such processes are available from many suppliers, including Ashland, Acme, Foseco, and McCormick. The disclosed invention was practiced with a urethane cold box process using Ashland Chemical as the resin and catalyst supplier. As with many core-making processes, when the sand and resin are first mixed together, the resin-coated sand is blown into the core box, and then the resin is cured—either chemically, using a catalyst, or with heat—to form a solid core.

When extracted from the core box 12, the barrel slab core 14 includes iron liners 10 on the outside diameter of the barrel cores 18 (FIG. 2), such that the cylinder bore liners 10 form an integral part of the barrel core 18 and of the barrel slab core 14.

In assembling the cylinder block core sand mold package 22 depicted in FIG. 1, the completed barrel slab core 14 is assembled in combination with other cores, including end cores 50 (FIG. 3), crank case cores 24, side cores 26, 28, etc. The cylinder block core sand mold package 22 is then filled with molten metal, such as aluminum.

For orientation (FIGS. 1, 3), other components of the cylinder block mold package 22 include water jackets 36, an oil drain ladder 38, an oil gallery 40, a vent/-breather core 42, and a main oil gallery 48.

Figure 3:
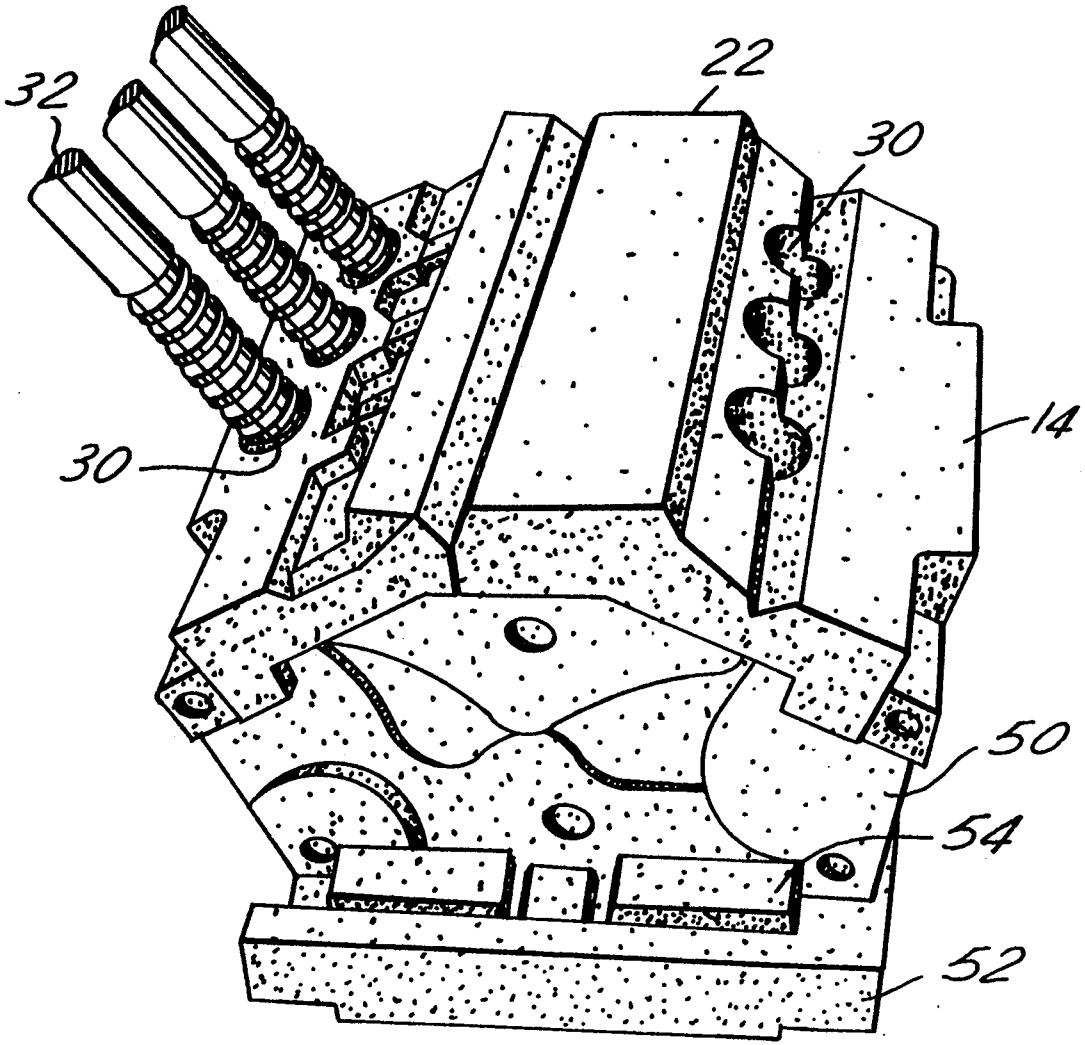
FIG. 3 is a perspective view of the assembled bonded sand cylinder block mold package, illustrating access holes defined within the barrel slab core, through which induction heaters are removably inserted.

Turning now to FIG. 3, there is depicted in perspective the cylinder block mold package 22 including a barrel slab core 14, which defines therewithin access holes 30. Each access hole 30 (see also, FIG. 1) provides communication to an associated barrel core 18.

Induction heaters 32 are removably inserted through access holes 30 with a predetermined longtitudinal displacement so as to provide little or no mechanical contact between a leading edge of the induction heater 32 and the floor of associated barrel core 18.

To ensure optimum integrity of the aluminum casting/iron liner interface, the cylinder bore liners 10 are heated (typically for up to 16 seconds to a range of 600°-900° F.) before filling the mold with molten aluminum. Just prior to mold filling, the assembled cylinder mold core package 22 is positioned at an induction heating station. Induction heating coils 32, one for each cylinder, are inserted through the access holes 30 which communicate through the back of the head deck 16 to the interior of the barrel cores 18.

When power is supplied, the coils 32 heat the cylinder bore liners 10 to the desired temperature. The sand of the barrel cores 18 is situated between the heating coil 32 and the associated cylinder bore liner 10. Such sand is invisible to induction heating energy. Accordingly, when power is generated, generated, the coils 32 heat the cylinder bore liners 10 to the desired temperature.

At the end of the heating cycle, the induction heating coils 32 are retracted, and the cylinder block mold package 22 is indexed to the pouring station for metal filling.

Figure 5:
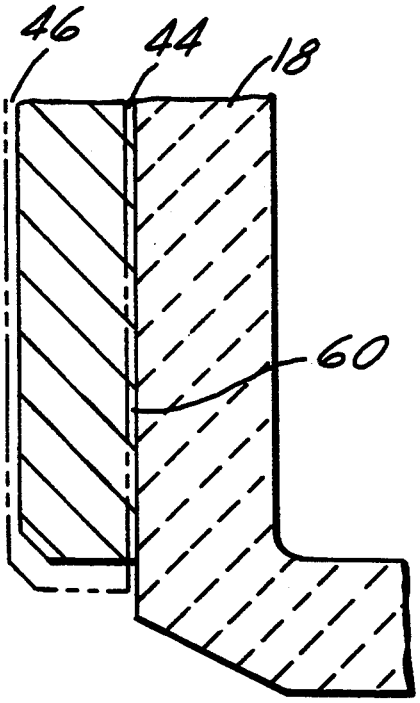
FIG. 5 is a partially sectioned view of a barrel core and the cylinder bore liner, illustrating a gap formed therebetween in prior approaches when the liner expands from an unheated to a heated condition.

During mold assembly, if the barrel slab core 14 is aged, the cylinder bore liner 10 may slip off the barrel core 18 due to core shrinkage as curing continues. The need for a more positive method of locating the cylinder bore liners 10 in relation to the barrel slab core 14 is highlighted by the fact that during induction heating, the cylinder bore liner 10 expands under thermal influence. As a result, as depicted in FIG. 5, the cylinder bore liner 10 may become displaced in relation to the barrel core 18 until it comes into contact with a crank case core 24. Accordingly, the cylinder bore liner 10 falls out of position within the cylinder block casting.

Expansion of the cylinder bore liner 10 during induction heating results in a gap 60 being formed between the cylinder bore liner 10 and the barrel core 18. While the cylinder block mold core package 22 is being filled with aluminum, unless sealed, the gap 60 partially fills. The aluminum in the gap 60 is known as flash. During engine block machining, fixtures locate on the iron cylinder bore liners 10. If they locate on the flash instead of the liner, the entire block will be mislocated and machined improperly. The result is a scrapped engine block.

Figure 4:
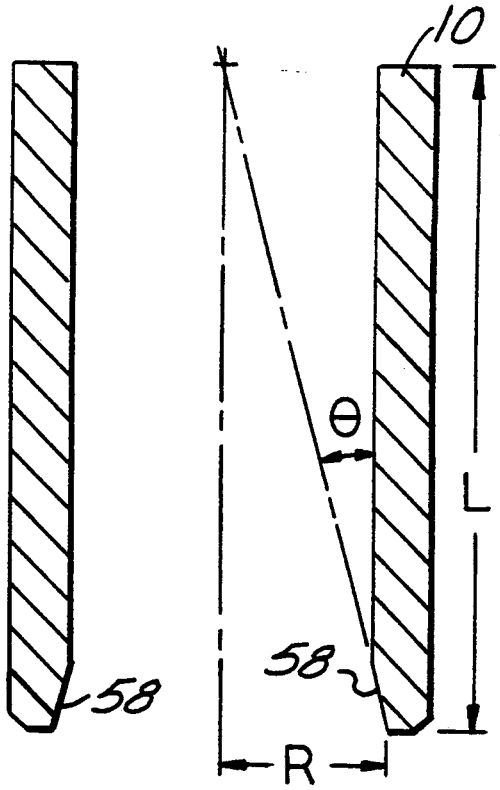
FIG. 4 is an axial sectional view of a cylinder bore liner illustrating an internal diameter chamfer incorporated into the design thereof.
Figure 6:
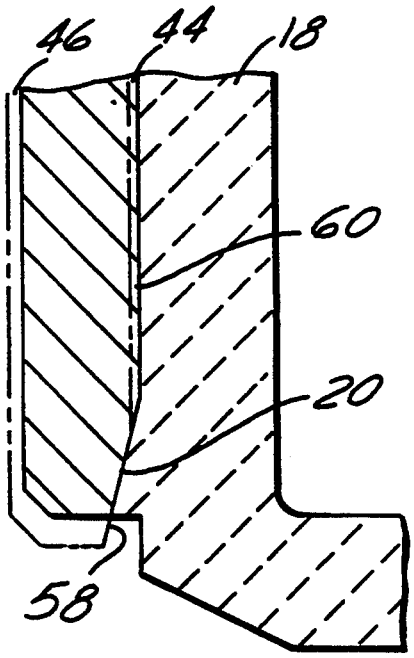
FIG. 6 is a partially sectioned view of the barrel core including an anchoring means which secures the bore liner to the barrel core.

To eliminate such problems, an internal diameter (ID) chamfer 58 (FIGS. 4, 6) has been incorporated into the cylinder bore liner design 10. The chamfer angle ($\theta$) is determined by the geometric relationship of the length (L) of the cylinder bore liner 10 and its inside radius (R).

The angle ($\theta$) is such that movement of the bottom inside corner of the cylinder bore liner 10 during thermal expansion is constant, both linearly and radially.

With this angle ($\theta$) formed in the cylinder bore liner 10 as a chamfer 58, during heating, the chamfer surface 58 always remains in contact with the barrel core 18. Such continuous contact acts as a seal which prevents aluminum from filling the remaining gap 60 formed above the chamfer 58 (FIG. 6) and prevents the cylinder bore liner 10 from migrating or slipping out of position.

When the barrel core 18 is prepared, its outside diameter is formed by the inside diameter of the cylinder bore liner 10. The ID chamfer 58 of the liner 10 creates an anchoring means 20 (FIG. 6) which is formed from a progressive increment in the diameter of the barrel core 18, thus locking the cylinder bore liner 10 in place in relation thereto.

Figure 8:
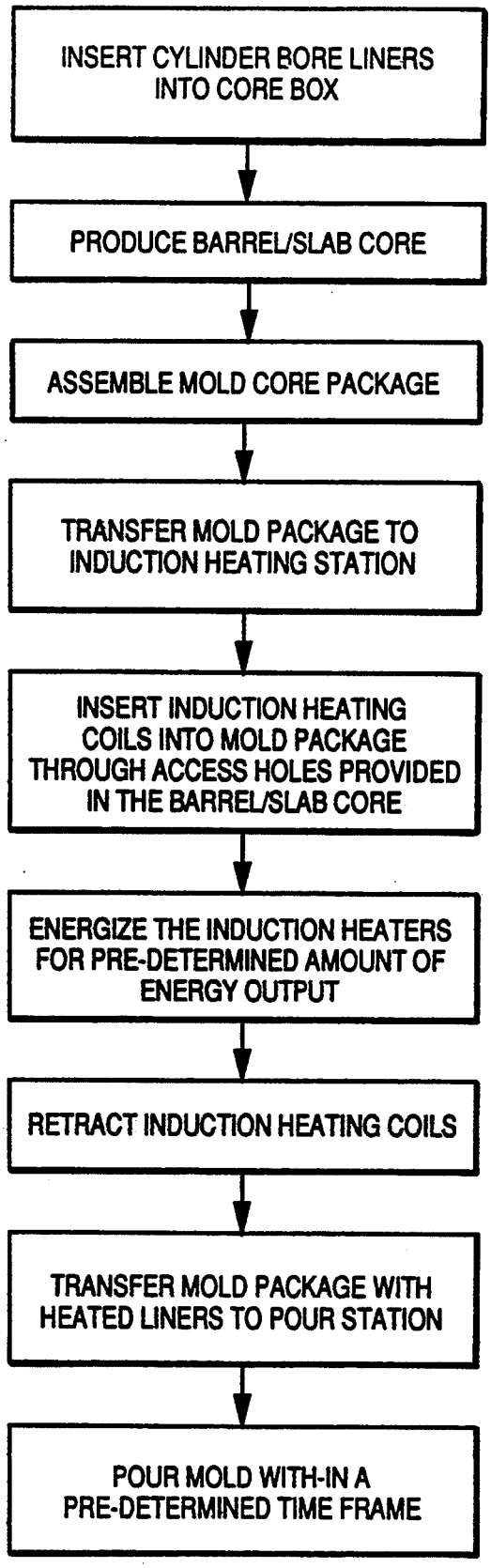
FIG. 8 is a flow diagram of the method steps of the present invention.

FIG. 8 illustrates the major process steps in preparing an engine block casting.

The method comprises the steps of:

(1) inserting the cylinder bore liners 10 within a core box 12 (FIG. 7). The core box 12 defines a cavity 66 which shapes a barrel slab core 14 for forming the cylinder bores within the engine block. The barrel slab core 14 includes barrel cores 18 which are surrounded by the bore liners 10;

(2) the barrel slab core 14 is then removed from the core box with the cylinder bore liners 10, each liner 10 being fixed in relation to the barrel slab core 14;

(3) the cylinder block mold core package 22 is then assembled from the barrel slab core 14, end cores 50, crank case cores 24, and side cores 26, 28;

(4) the cylinder bore liners 10 are then heated while they are within the cylinder block mold package 22 by induction heating; and (5) a molten metal is then poured into the cylinder block mold package 22.

Preferably, the access holes 30 are defined within the back of the barrel slab core 14, each access hole 30 communicating with the interior of one barrel core 18. The heaters 32 are inserted through the access holes 30 so that thermal energy may be transferred across the barrel core 18 to the associated cylinder bore liner 10 to ensure optimum integrity of bonding between a solidified cylinder block casting and the cylinder bore liners. The heaters 32 are then retracted before a melt is added.

Preferably, the heaters 32 are energized so that they deliver a predetermined amount of energy. Experiments have shown that it is proven feasible to heat the cylinder bore liners 10 from ambient temperature to 650° F. in 10 seconds. However, the period of time for which the induction heaters 32 are energized is not necessarily limited to up to 10 seconds. It has been found that the energization period varies depending on cylinder bore diameter, liner thickness, liner o.d. groove pattern, induction heater power output, and metal pouring temperature, among other factors. For example, the recommended heating time to produce an acceptable liner-bore interface for a 2.5 L block casting is about 16 seconds.

Optimally, the molten metal is added to the cylinder block mold core package 22 within a predetermined time after the heating step.

Thus there has been disclosed a method of preparing an engine block casting using cylinder bore liners which are integral with the barrel slab core 14. The cylinder bore liners 10 are secured to the barrel slab core 14 by anchoring means 20 in the form of an ID chamfer 58. When ejected from the core box, the cylinder bore liners 10 are securely located on the outside surface of the barrel cores 18 of the barrel slab core 14.

To avoid prolonged exposure to heat during liner preheating, and consequent deterioration of adjacent mold components (such as a water jacket core 36), induction heaters 32 are inserted through access holes 30 provided within the back of the barrel slab core 14. As a result, it has proven feasible to uniformly heat the cylinder bore liners 10 from ambient temperature to 650° F. in about 10 seconds, thereby minimizing the period of deterioration of the core.

Initial results have shown that the concept of cast-in liner aluminum engine block production is cost effective and represents a superior quality alternative to conventional pressed-in place liner approaches.

While the best mode for carrying out the invention has been described in detail, those familiar with the art to which this invention relates will recognize various alternative designs and embodiments for practicing the invention as defined by the following claims.

We claim:

1. A method for preparing an engine block casting having mechanically bonded, cast-in place cylinder bore liners, comprising the steps of:

inserting the cylinder bore liners within a core box adapted for shaping a barrel slab core, the barrel slab core including barrel cores, the bore liners surrounding the barrel cores so that the liners are integrally associated with the barrel slab core by mechanical cooperation therebetween;

removing the barrel slab core with the cylinder bore liners from the core box, the cylinder bore liners being fixed in relation to the barrel slab core;

assembling a cylinder block sand mold package from the barrel slab core, end cores, crankcase cores, and side cores and other related cores;

heating the liners while they are within the cylinder block sand mold package by induction heating before filling the cylinder block mold package with molten metal casting to prevent premature freezing of the molten metal casting and thus assuring optimum integrity of mechanical bonding between a solidified cylinder block casting and the cylinder bore liners; and filling the cylinder block sand mold package with molten metal casting.

2. The method of claim 1, wherein the heating step comprises the steps of:

providing access holes defined within the barrel slab core, each access hole communicating with the interior of one barrel core;

inserting through each access hole a heater so that thermal energy may be transferred across the associated barrel core to a mating cylinder bore liner to assure optimum integrity of bonding between a solidified engine block casting and the cylinder bore liners; and retracting the heaters before adding the molten metal.

3. The method of claim 2, wherein the heating step further comprises:

energizing the heater so that it delivers a pre-determined amount of energy.

4. The method of claim 3, wherein the step of energizing the heater is performed for a period of up to 16 seconds.

5. The method of claim 3, wherein the predetermined amount of energy is sufficient to raise the temperature of the cylinder bore liner from ambient to 650° F.

6. The method of claim 1, wherein the step of pouring molten metal into the cylinder block mold core package comprises:

pouring the molten metal within a pre-determined time after the heating step.

7. The method of claim 1, further comprising the step of:

providing anchoring means disposed upon the cylinder bore liners for securing the cylinder bore liners in relation to the barrel slab core.

8. The method of claim 7, wherein the anchoring means comprises:

a chamfer disposed on the inside of the cylinder bore liners so that an interface between the chamfer of the cylinder bore liner and the associated barrel core forms a continuous contact which blocks the passage of molten metal into a gap formed between an outside diameter of the barrel core and an inside diameter of the associated cylinder bore liner and prevents the cylinder bore liner from slipping out of position.

9. A barrel slab core and liner in combination for use in a cylinder block mold package which is adaptable for forming an engine block casting, the barrel slab core comprising:

a slab core;

a plurality of barrel cores for forming piston cylinders extending from the slab core;

an uncoated cylinder bore liner integral with, and surrounding each barrel core; and an anchoring means disposed upon each cylinder bore liner for securing each liner in relation to an associated barrel slab core, wherein the anchoring means comprises:

a chamfer disposed on the inside of the cylinder bore liners so that an interface between the camfer of the cylinder bore liners and the associated barrel cores form a continuous contact which blocks the passage of molten metal into a gap formed between an outside diameter of a barrel core and an inside diameter of the associated cylinder bore liner and prevents the cylinder bore liner from slipping out of position.

10. The barrel slab core of claim 9, wherein the chamfer includes:

a chamfer angle ($\theta$) which is determined by the geometric relationship of the length (L) of a cylinder bore liner and its inside radius (R), the geometric relationship being selected such that movement of a bottom inside corner of each cylinder bore liner during thermal expansion is constant, both linearly and radially.

* * * * *